US007530652B2

(12) United States Patent
Lodge

(10) Patent No.: US 7,530,652 B2
(45) Date of Patent: May 12, 2009

(54) ROTARY FILING CABINET SYSTEM AND METHOD

(75) Inventor: Reggie Lodge, Wheaton, IL (US)

(73) Assignee: Richards-Wilcox, Inc., Aurora, IL (US)

( * ) Notice: Subject to any disclaimer, the term of this patent is extended or adjusted under 35 U.S.C. 154(b) by 958 days.

(21) Appl. No.: 10/859,648

(22) Filed: Jun. 3, 2004

(65) Prior Publication Data

US 2005/0269918 A1 Dec. 8, 2005

(51) Int. Cl.
*A47F 3/10* (2006.01)
*A47B 49/00* (2006.01)

(52) U.S. Cl. ..... 312/305; 312/198

(58) Field of Classification Search ..... 312/107, 312/111, 125, 198, 199, 304, 305, 263, 265.1, 312/265.2, 265.3, 265.4, 265.5, 265.6, 257.1, 312/135

See application file for complete search history.

(56) References Cited

U.S. PATENT DOCUMENTS

| | | | | | |
|---|---|---|---|---|---|
| 935,249 | A | * | 9/1909 | Doxtator | 312/123 |
| 3,713,717 | A | * | 1/1973 | Hafner | 312/195 |
| 3,868,157 | A | * | 2/1975 | Robinson | 312/305 |
| 4,368,936 | A | * | 1/1983 | Worrallo | 312/140 |
| 5,486,041 | A | * | 1/1996 | Sykes | 312/111 |
| 5,547,273 | A | * | 8/1996 | Hudnall | 312/305 |

* cited by examiner

*Primary Examiner*—James O Hansen
(74) *Attorney, Agent, or Firm*—Schiff Hardin LLP

(57) ABSTRACT

The rotary filing cabinet system and method is provided wherein a short adder cabinet is provided between a tall starter cabinet and a tall adder cabinet. The short adder cabinet includes a tall right front panel assembly of a height which is the same as the height of the tall adder cabinet, and further including first and second covering panels which cover respective side openings above a top panel of the short adder cabinet at a left side of the tall adder cabinet and at a right side of the tall starter cabinet.

9 Claims, 2 Drawing Sheets

ROTARY FILING CABINET SYSTEM AND METHOD

BACKGROUND

As shown in U.S. Pat. No. 3,868,157 (hereinafter the "'157' patent") incorporated herein by reference, it is known to provide a rotary filing cabinet system having what is known as a starter cabinet followed by one or more of what are known as adder cabinets arranged in line with the starter cabinet. In this prior art system, as shown in FIG. 1 of the '157 patent, two adder cabinets, for example, may follow to the right of the starter cabinet. Each of these two adder cabinets has a smaller front width than a front width of the starter cabinet, even though the rotor containing shelves for each filing cabinet has the same front width. Although the starter cabinet has a left and a right front panel assembly lying to the left and to the right of the rotor, the two adder cabinets only have a right front panel assembly at the right side of the rotor. In the two adder cabinets, no left front panel assemblies are provided since sufficient spacing exists for the rotor in the two adder cabinets to turn without the corners of the rotor hitting the adjacent rotor, since no internal sidewalls are provided between the starter and the first adder cabinets, or between the two adder cabinets.

With this prior art unit, floor space is saved with such an arrangement of starter plus two adder cabinets since the two adder cabinets have a narrower width than the starter cabinet.

As shown in the '157 patent, both the starter and the two adder cabinets have a same height. However, if it is desired to have a short adder cabinet lying between a tall starter cabinet and another tall adder cabinet, it was known in the prior art that all three of the short adder cabinet, the tall starter cabinet, and the tall adder cabinet must be of a full size width which is the same for all three cabinets, assuming the rotors of the three cabinets all have a same width. This has the disadvantage of requiring more floor space.

SUMMARY

It is an object to provide a short rotary filing cabinet between two tall rotary filing cabinets, but wherein floor space occupied by the three cabinets is minimized.

The rotary filing cabinet system and method is provided wherein a short adder cabinet is provided between a tall starter cabinet and a tall adder cabinet. The short adder cabinet includes a tall right front panel assembly of a height which is the same as the height of the tall adder cabinet, and further including first and second covering panels which cover respective side openings above a top panel of the short adder cabinet at a side of the tall adder cabinet facing the short cabinet and at a right side of the tall starter cabinets facing the short cabinet.

DESCRIPTION OF THE PREFERRED EMBODIMENT

Figure 1:
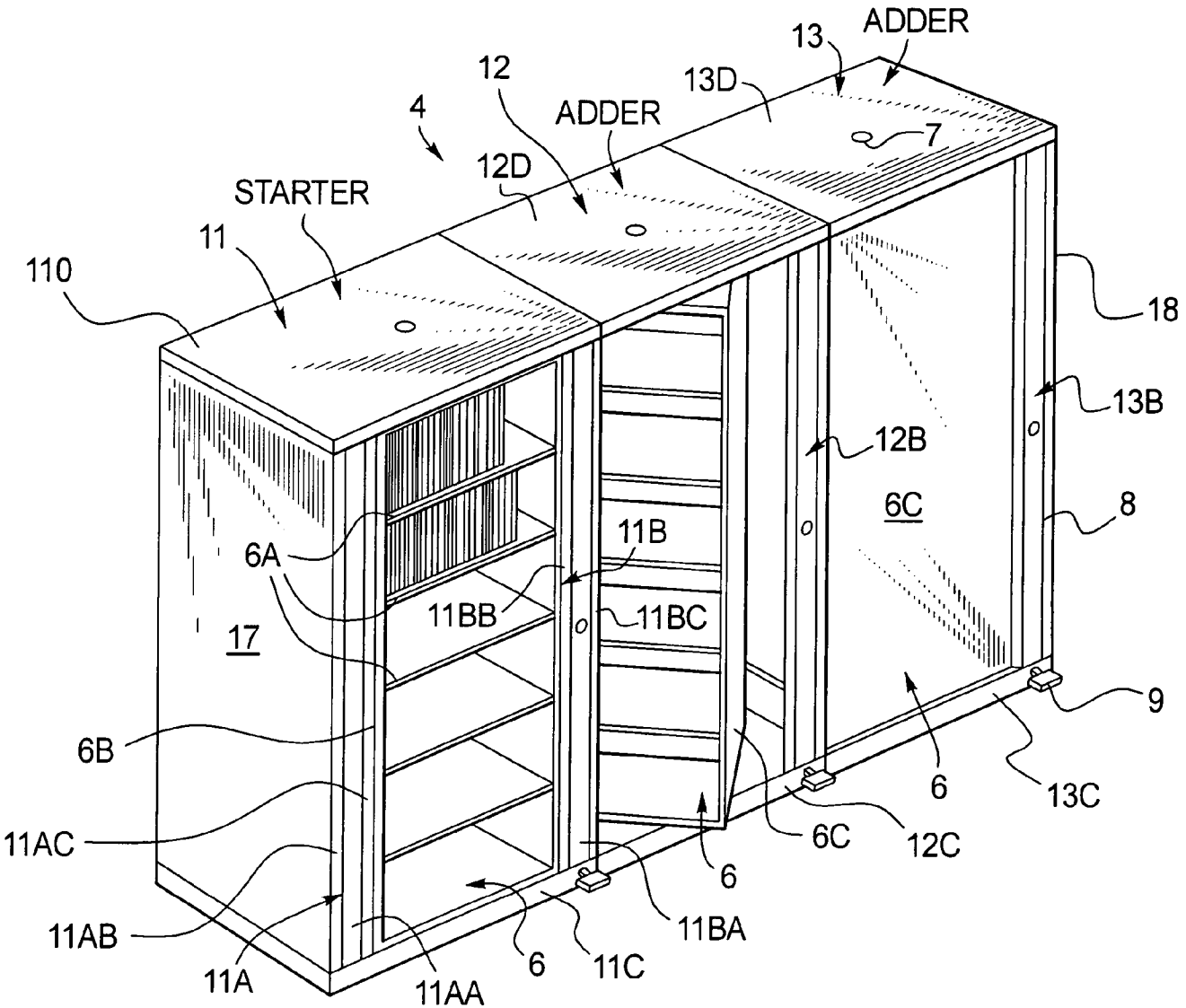
FIG. 1 (PRIOR ART)
FIG. 1 is a perspective view of a prior art rotary filing cabinet system.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
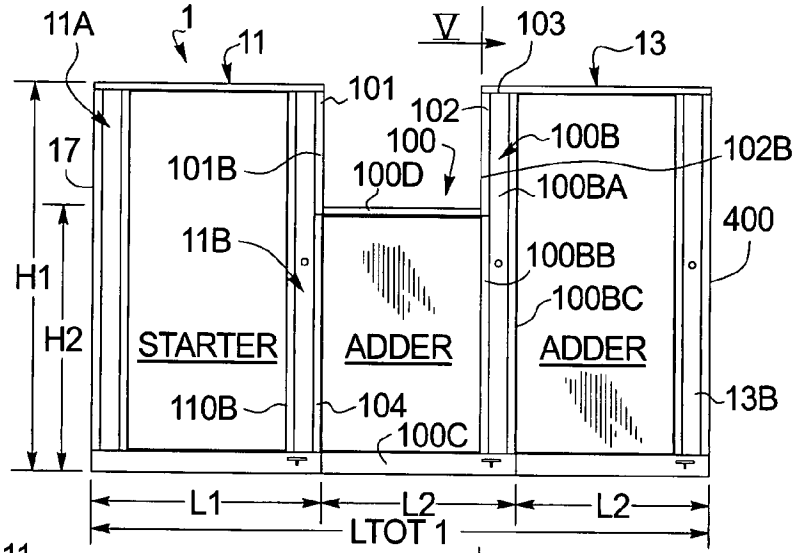
FIG. 4 is a front view of an improved rotary filing cabinet system employing a short central cabinet flanked by two tall cabinets which occupies less floor space than the prior art system of FIG. 3.
Figure 5:
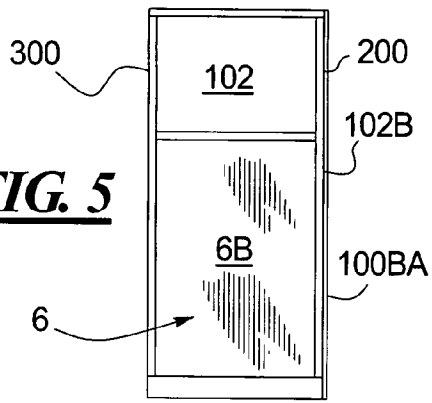
FIG. 5 is a sectional view taken along line V-V of FIG. 4.

First, the prior art FIGS. 1, 2 and 3 will be described to aid in understanding the improvements made in the disclosed preferred embodiment as shown in FIGS. 4 and 5.

The prior art rotary filing cabinet system is generally shown at 4 in FIG. 1. The system includes three rotary filing cabinets, namely a starter cabinet 11, an adder cabinet 12, and another adder cabinet 13. A front width of the adder cabinets 12 and 13 is less than a front width of the starter cabinet 11, even though the rotors 6 in each of these cabinets have same outer dimensions including a same front width. The reduced width of the two adder units 12 and 13 results from the elimination of a left most front panel assembly provided in the starter cabinet 4 but not in the two adder cabinets 12 and 13. As shown in FIG. 1, the starter cabinet 11 has a left front panel assembly 11A and a right front panel assembly 11B. The two adder units 12 and 13 only have respective right front panel assemblies' 12B and 13B. Because there are no divider panels between the adder cabinets 12 and 13, and between the starter cabinet 11 and the adder cabinet 12, there is sufficient clearance for all of the rotors 6 to rotate without hitting each other at the respective corners of the rotors as the rotors are rotated.

The left front panel assembly 11A is formed of a metal face 11AA of a first front corner post flanked at one side by a metal lip 11AB of a left side lip of end panel 17 and at the other side by a vinyl strip 11AC. The right front panel assembly 11B has a front metal face 11BA of a second front corner post flanked by respective vinyl strips 11BB and 11BC. The front panel assembly 12B is formed like assembly 11B and front panel assembly 13B is formed like assembly 11A, but with the metal lip and vinyl strip reversed.

Each of the rotors 6 may have a plurality of shelves 6A and side panels 6B and 6C. Both the front and the back of the rotor 6 are open so that when the rotor is rotated 180°, files 3 from the back can be removed. A central vertical divider panel may be provided to create front and back file compartments.

A lock 8 is provided on each of the right side front metal faces. Foot pedals 9 are provided for each of the cabinets. When the pedals are depressed, the rotors can be rotated.

A pivot axis 7 for each of the rotors is shown at the top of each cabinet.

Each of the cabinets 11, 12 and 13 has a respective base 11C, 12C, and 13C.

The system also has left and right side end panels 17 and 18.

At the top of the system respective top panels 11D, 12D and 13D are provided.

Other structural details of the prior art system shown in FIG. 1 can be learned from aforementioned '157 patent incorporated herein.

Figure 2:
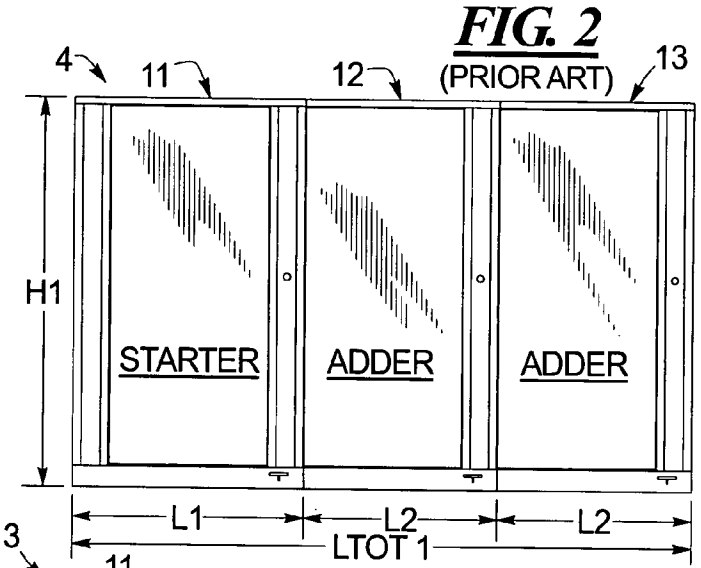
FIG. 2 (PRIOR ART)
FIG. 2 is a front view of the prior art rotary filing cabinet system of FIG. 1.

A front view of the prior art system of FIG. 1 is shown in FIG. 2. Here it can be seen that the width L1 of the starter cabinet 11 is greater than the width L2 of the adder cabinet 12 and adder cabinet 13. The overall width LTOT1 of the system 4 is also shown. The system 4 has a height H1.

In many installations, it is desirable to have a short center cabinet flanked by two tall cabinets. As shown in the prior art system 3 a tall starter cabinet 11 having height H1 is provided along with a middle short starter cabinet 2 having height H2 followed by another tall starter cabinet 11 of height H1. The width L1 of all of the starter cabinets 11, 2 and 11 are the same. Thus more floor space results than for system 4 shown in FIGS. 1 and 2. Here it can be seen that the short starter cabinet 2 has a left front panel assembly 2A and a right front panel assembly 2B. The two starter cabinets 11 each have the left front panel assembly 11A and the right front panel assembly 11B. Because of the inclusion of the short left front panel assembly 2A and the short right front panel assembly 2B in the short starter cabinet 2, the overall width LTOT2 is thus greater than the overall width LTOT1 in FIG. 2; thus more floor space is occupied. This is a disadvantage of the prior art system of FIG. 3.

Figure 3:
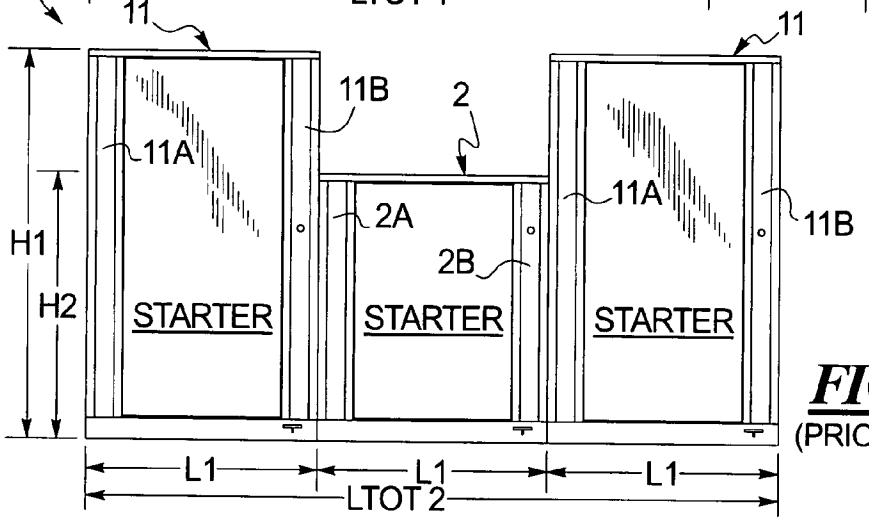
FIG. 3 (PRIOR ART)
FIG. 3 is a front view of the prior art rotary filing cabinet system having one short cabinet flanked by two tall cabinets.

With the improved rotary filing cabinet system 1 having a short adder cabinet as shown in FIG. 4, the same amount of floor space is occupied as was the case for system 4 in FIG. 2, which is less floor space than shown in prior art FIG. 3 also having a short cabinet.

As indicated in FIG. 4, a tall starter cabinet 11 is employed which is the same as the tall starter cabinet 11 shown in prior art FIGS. 1, 2, and 3. Also, to the right side of system 1 the tall adder cabinet 13 is the same as the tall adder cabinet 13 in FIGS. 1 and 2. However, the central short adder cabinet 100 has no short panel assemblies, but rather, includes a tall right front panel assembly 100B having a height H1 taller than the height H2 of the short adder cabinet 100. Of course the starter cabinet 11 has the same left front panel assembly 11A and right front panel assembly 11B previously described. Similarly, the adder cabinet 13 on the right side has the same right front panel assembly 13B previously described.

The short adder cabinet 100 has a base 100C and a top panel 100D.

The tall right front panel assembly 100B is formed of a tall front face 100BA of a front corner post 200 with a tall vinyl strip 100BC to the right of this front face. To the left of the front face is a short vinyl strip 100BB. Above the level of the top panel 100D is a lip 102B of a cover panel 102, on adder cabinet 13, clearly shown in the cross-sectional view of FIG. 5 taken along line V-V of FIG. 4. Opposite the cover panel 102 a corresponding cover panel 101 is provided on starter cabinet 11 and having a lip 101B. Also a short vinyl strip 104 is provided for tall right front panel assembly 11B.

As also shown in FIG. 5, a rear corner post 300 is provided.

Thus, when the system is sold, to create the layout shown in FIG. 4, the starter cabinet 11 and adder cabinet 13 are sold to the customer, as was the case in the prior art system of FIG. 2. However, for the short central cabinet 100, the customer is sold the base 100C, top panel 100D, the tall right front panel assembly 100B which is taller than the height of the short cabinet, and the two cover panels 101 and 102. The customer receives as part of the front panel assembly 100B the short vinyl strip 104, front corner post 200, and tall vinyl strip 100 BC. He also receives the rear corner post 300 and short vinyl strip 104. The end panel 400 comes from the right side of starter cabinet 11, which also has the pre-existing left side end panel 17. With the improved system 1 of FIG. 4, the same amount of floor space is achieved as with the prior art FIG. 2 system 4, but a central short cabinet 100 is employed. Thus, floor space is saved in the improvement of FIG. 4 compared to the prior art of FIG. 3.

Although in the foregoing preferred embodiment is was described that the tall cabinets flanking the central short cabinet were the same height, this is not required within the scope of the invention. Also additional intermediate short cabinets may be employed where those short cabinets have different heights compared to each other.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim as my invention:

1. A rotary filing cabinet system, comprising:

a tall existing starter rotary filing cabinet comprising as viewed from the front a left end panel mounted to a left corner post, a left flexible strip mounted to the left corner post, a right flexible strip, a rotor with shelving and a side panel, a width of the side panel extending from the left flexible strip to the right flexible strip, a right front corner post to which the right flexible strip is mounted, and a right end panel; and a short adder rotary filing cabinet kit which, when assembled, forms a short adder rotary filing cabinet as an abutting addition at a right side of the tall existing starter rotary filing cabinet, said tall starter cabinet right front corner post also being a left front corner post for said short adder cabinet so that only one front corner post is provided between the tall starter and short adder cabinets, said short adder rotary filing cabinet kit comprising a cover panel for connection to the tall starter cabinet right front corner post when placed above a top of the short adder cabinet and after removal of said tall starter cabinet right end panel, a left flexible strip for direct attachment to the tall starter cabinet right corner post, a right flexible strip, a rotor with shelving and a side panel, a width of the side panel extending from the left flexible strip to the right flexible strip, said width being substantially the same as said rotor side panel width of said tall starter cabinet, and a right front corner post to which is attached the right flexible strip.

2. A system of claim 1 wherein a tall adder rotary filing cabinet kit is also provided which, when assembled, forms a tall adder rotary filing cabinet as an addition to the right of said short adder cabinet, said short adder cabinet right corner post also being a tall left corner post for said tall adder cabinet so that only one front corner post is provided between the short adder and tall adder cabinets, and said tall adder rotary filing cabinet kit comprising an additional cover panel for connecting to said tall adder cabinet left corner post when placed above said top of the short adder cabinet, a left flexible strip directly attached to said tall adder cabinet left corner post, a right flexible strip, a rotor with shelving and a side panel, a width of the side panel extending from the left flexible strip to the right flexible strip, said width being substantially the same as the side panel width of the tall starter and short adder cabinet rotors, a right front corner post attached to said right flexible strip, and said removed starter cabinet right end panel being used as a right end panel for connection to said tall adder right front corner post.

3. A system of claim 2 wherein the tall starter and tall adder cabinets have a substantially same height.

4. A system of claim 1 wherein the end panels and the cover panel have a lip.

5. A system of claim 1 wherein the flexible strips comprise vinyl.

6. A method for providing a short adder rotary filing cabinet as an extension onto an existing tall starter rotary filing cabinet which a user already has, said tall starter cabinet comprising as viewed from the front a left end panel, a left corner post to which the left end panel is connected, a left flexible strip connected to the left corner post, a right flexible strip, a rotor having a side panel width extending from the left flexible strip to the right flexible strip, a right front corner post to which the right flexible strip is connected, and a right end panel connected to the right front corner post, comprising the steps of:

delivering to the user having the existing starter rotary filing cabinet a short adder rotary filing cabinet kit which, when assembled and viewed from the front, forms the short adder rotary filing cabinet which is to be placed adjacent to and abutting a right side of said tall starter rotary filing cabinet, said tall starter cabinet right front corner post also being a left front corner post for said short adder cabinet so that only one front corner post is provided between the tall starter and short adder cabinets, said short rotary filing adder cabinet kit including a cover panel, a left flexible strip, a right flexible strip, a rotor having a side panel with a width extending from the left flexible strip to the right flexible strip, said width being substantially the same as said side panel width of said tall starter cabinet rotor, and the right flexible strip being connected to a right front corner post; and to assemble the short adder cabinet to the tall starter cabinet, removing the right end panel from the tall starter cabinet and assembling the short rotary cabinet kit, including mounting the cover panel to said right front corner post of said starter cabinet above a top of the short adder cabinet, directly attaching the left flexible strip to the tall filing cabinet right corner post, and attaching the right flexible strip to the right corner post.

7. A method of claim 6 including also shipping to the customer having the existing starter rotary filing cabinet and the short adder cabinet kit a tall adder rotary filing cabinet kit for addition of a tall adder rotary filing cabinet to the right of the short adder cabinet, said right front corner post for said short adder cabinet also being a left front corner post for said tall adder rotary filing cabinet so that only one front corner post is provided between the short adder and tall adder cabinets, and said tall adder cabinet kit comprising an additional cover panel, a left flexible strip, a right flexible strip, a rotor having a side panel with a width for extending from said left flexible strip to said right flexible strip, said tall adder cabinet side panel being substantially the same as said side panel width of said tall starter cabinet rotor and short adder cabinet rotor, and a right corner post; and assembling said tall adder cabinet kit along with assembling said short adder cabinet kit, and utilizing the removed right end panel of said tall starter cabinet as a right end panel of said tall adder cabinet attached to said right front corner post of said tall adder cabinet, said left flexible strip of said tall adder cabinet kit being directly attached to said right front corner post of said short adder cabinet kit.

8. A method of claim 6 wherein all of said flexible strips comprise vinyl.

9. A method of claim 6 wherein all of the end panels and the cover panel comprise a lip.

* * * * *